United States Patent [19]

George et al.

[11] Patent Number: 4,794,716

[45] Date of Patent: Jan. 3, 1989

[54] DISPLAY MOUNT DEVICE

[76] Inventors: Max A. George; Janet L. George, both of 1615 E. Sycamore, Kokomo, Ind. 46901

[21] Appl. No.: 36,993

[22] Filed: Apr. 10, 1987

[51] Int. Cl.[4] ..... B44C 5/02

[52] U.S. Cl. ..... 40/158.1; 40/159

[58] Field of Search ..... 40/158 R, 159, 152; D6/301, 303

[56] References Cited

U.S. PATENT DOCUMENTS

| | | | |
|---|---|---|---|
| D. 34,465 | 4/1901 | Rose | D6/301 |
| D. 231,299 | 4/1974 | Berchert | D6/301 |
| D. 276,055 | 10/1984 | Guertin | D6/301 |
| D. 290,787 | 7/1987 | Chisholm | D6/301 |
| 1,467,680 | 9/1923 | Oda | 40/159 |
| 3,174,244 | 3/1965 | Walton | 40/158 R |
| 3,335,514 | 8/1967 | Blackman | 40/158 R |
| 4,057,923 | 11/1977 | Chase | 40/158 R |
| 4,110,923 | 9/1978 | Shore | 40/158 R |
| 4,531,316 | 7/1985 | Farnum | 40/158 R |
| 4,662,093 | 5/1987 | Suttles et al. | 40/159 |

FOREIGN PATENT DOCUMENTS

| | | | |
|---|---|---|---|
| 3235 | of 1887 | United Kingdom | 40/158 R |

*Primary Examiner*—John J. Wilson
*Assistant Examiner*—Cary E. Stone
*Attorney, Agent, or Firm*—Robert A. Spray

[57] ABSTRACT

A photo-mount device formed to present a charactery of a school bus, with cut-outs in the outer panel through which may be viewed photographs of a child taken sequentially through the years.

4 Claims, 2 Drawing Sheets

DISPLAY MOUNT DEVICE

FIELD OF THE INVENTION

The present invention relates to a photo-mount device for mounting a sequence of photographs of a child, taken periodically as the child grows through the years of elementary school and high school.

More particularly, the device provides both a convenient way of mounting a sequential series of photographs, for the special effect of showing the maturation of the child, and an attractive and novel way of displaying the photos, either presented as a wall-hung decoration or as a picture mount for standing on a shelf or other horizontal surface such as a mantel, table, stereo speaker or the like.

PRIOR ART OF THIS FIELD EMPHASIZES INVENTIVE NOVELTY

Photos are of course mounted for display, including the use of display mounts which mount and display a plurality of pictures; and such mounts have been known and widely used for many scores of years.

This of course is not only recognized but is emphasized, for the comparison of such widely-known photo display mounts to the mount device of the present invention helps show the inventive non-obviousness and novelty of the present device, especially since the display mount here is of such economical construction and is a type of product known and used so universally.

Further, it seems no doubt very likely that almost every child in the modern world has at least one picture taken each year, and it is likely that almost every child's pictures are occasionally looked at by looking at more than one picture at a time, i.e., by looking at several taken respectively at different periods, noticing the growth or maturation of the child by comparison of the various photos of the child.

Another factor of prior art, helping here to show inventive novelty, is that school busses are widely known vehicles, and are known to have a plurality of windows, through which are seen a multiplicity of children; and although of course in real life one would see a multiplicity of different children, nevertheless the overall impression is that of a school bus with children's faces seen through many if not all of the bus windows.

Still further, the prior art discovered in a Search of U.S. Patent Office files, after this invention was made and during the consideration of trying for a patent award, further helps show here the inventive novelty. The references cited in that Search were as follows, with differences from the present invention noted as follows:

a. U.S. Pat. No. Des. 211,186, of D. J. Smith et al. (1968): This design patent shows a rectangular picture frame of two panel bodies, but there is no vehicular object shape or any other shape to which would relate to the pictures or a possible sequence-display, and no suggestion of a sequence display.

b. U.S. Pat. No. 3,371,439 presumably by the same inventors (1968): This seems even more remote; and even a suggestion of any sequential mounting is negated by the illustrated photos, and no relation to a vehicle is shown.

c. U.S. Pat. No. Des. 9485 of A. Griffin (1876): This shows a plural-mount rack; but any sequentization of mountings is negatived by the diversity of photos shown as one alternative use and a business card assortment shown as the other use, and there is no vehicle shape or suggestion.

d. U.S. Pat. No. Des. 147,504 of S. F. Miller (1947): This patent seems relevant only in showing photos mounted on a representation of a vehicle, particularly here an airplane, however; but no sequentialization of a maturing of a single individual is suggested, nor is suggested any double-panel formation. Further there is no suggestion of a reality-appearance of faces looking realistically out windows; and in contrast, in Miller the faces appear almost ghost-like, as apparitions unrealistically appearing in propeller housings of an airplane. The notion of any maturation presentation of sequential nature is further negated by the use of propeller mounts, limiting the quantity of photos to only about four as a maximum.

Thus, it is noted that the prior art helps actually to here emphasize the inventive novelty, because most or all of the factors or concepts contributing in combination to achieve the present invention were themselves almost universally known in a non-combined sense; but prior to the present invention those concepts or factors had not been combined in spite of the novelty and usefulness of the photo display which provides a novel, attractive, and desirable growth record of the child's maturation.

THE INVENTION SUMMARIZED

The invention is a photo mount device having an inner panel and an outer panel, one or the composite providing the shape and appearance of a school bus, both as to overall silhouette and as to surface design and features, particularly its windows.

The outer face of the inner panel is marked or otherwise provided with locators which, when the panels are in juxtaposed position, are in registry with cut-outs which provide the bus windows; and thus the arrangement provides that photos, when mounted onto the outer face of the inner panel, present the appearance, when the device is then viewed outwardly of the outer panel, of a series of photographic images showing through the cut-outs.

A transparent sheet between the panels, but outwardly of the photos mounted on the inner panel, economically provides the appearance of glass windows in the outer panel's cut-outs, furthering the appearance of photographic images being seen through windows.

Further, labels adjacent the outer panel's cut-outs specify the sequence of grade levels of elementary school and high school; and thus when photos of a certain child, which are taken each year of the child's school year, are mounted sequentially as indicated by the year-labels, the overall impression is that of a school bus charactery, through whose windows is seen pictorially a growth record of that child.

Thus, the overall device is an attractive novelty, self-proclaiming to the viewer as being such a growth record; and it not only gives the incentive for the parents to have an appropriate picture taken every year but it provides an attractive memorial for the child as a permanent keepsake, and a convenient way of mounting the pictures of the child's growth years.

BRIEF DESCRIPTION OF THE DRAWINGS

The above description of the novel school bus photo-mount means is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts and illustrating the use of the components of the invention in this embodiment:

In the drawings:

FIG. 2 is a folded-flat view of the outer and inner panels of the device, showing in face-on view the outer face of the outer panel, and in face-on view the inner or rear face of the inner panel, in an embodiment in which the full design charactery is on the outer face of the outer panel, excepting only the transparent sheet member is inwardly thereof; and FIG. 3 is a partly folded view of the outer and inner panels, showing the inner face of the inner panel and the outer face of the inner-panel, and with the transparent body member shown applied to the inner face of the outer panel, the folded-open nature of this view showing the mounting locators on the inner face of the inner panel which becomes the rear panel when folded into the device as it would be displayed, as by a sequential nature of photos showing through the transparent sheet and the cut-out openings of the front panel.

DETAILED DESCRIPTION OF THE ILLUSTRATED EMBODIMENT

Figure 1:
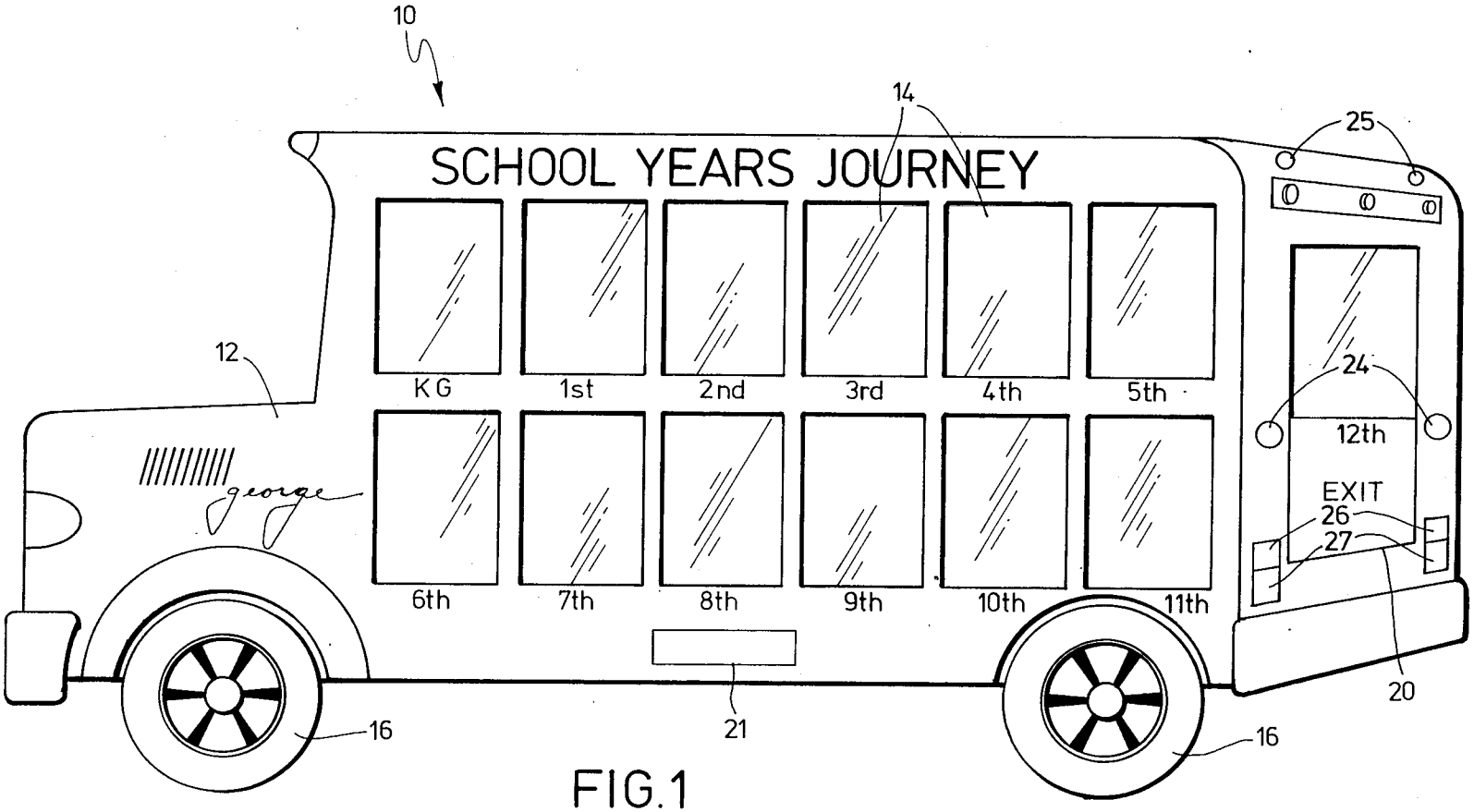
FIG. 1 is a side elevational view of a school bus vehicle with design features providing a charactery of a school bus with a plurality of windows and photo-mounting means according to concepts of the present invention, the view showing the outer panel in face-on view, the inner panel being hidden behind the outer panel except as it would show through the windows of the outer panel, no photos being yet mounted onto the device.

As shown in the drawings, the concepts of the present invention provide a display mount device 10 which is advantageously both a novelty item and a clever and attractive way of displaying photos, especially a sequence nature of photos of a child as the child matures through his schooling years.

More particularly in the form shown, the device provides a pair of body members connected by a connection means 11 and providing an outer panel 12 and an inner panel 13; and at least one (here the outer panel 12) is illustratively shown as shaped and presented so as to provide a charactery of a school bus.

The device 10 is of quite economical formation and structure, and is easy to use, all as described herein.

Figure 2:
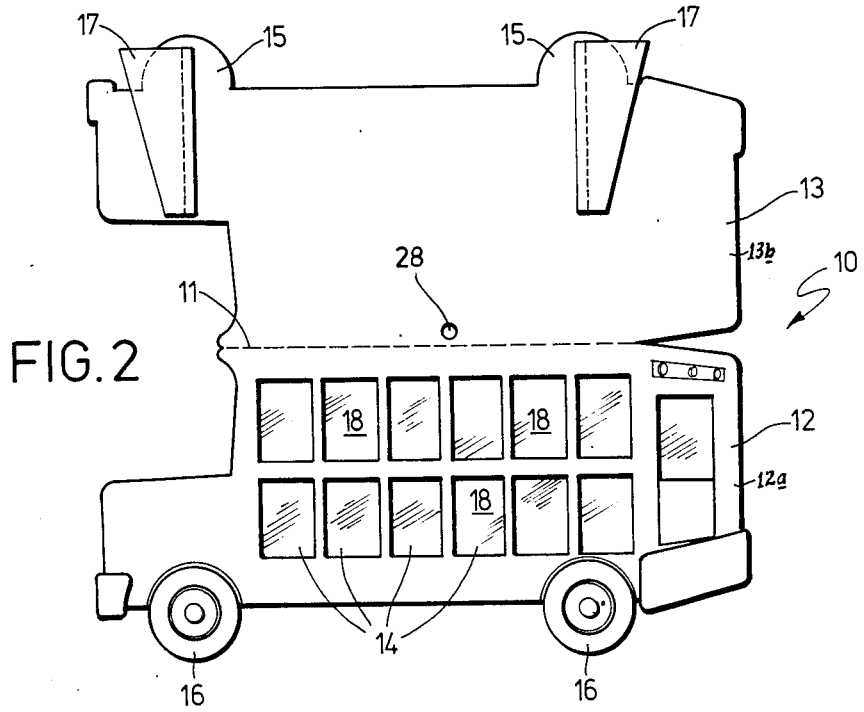
FIGS. 2 and 3 are somewhat reduced views of components of FIG. 1, and more particularly.
Figure 3:
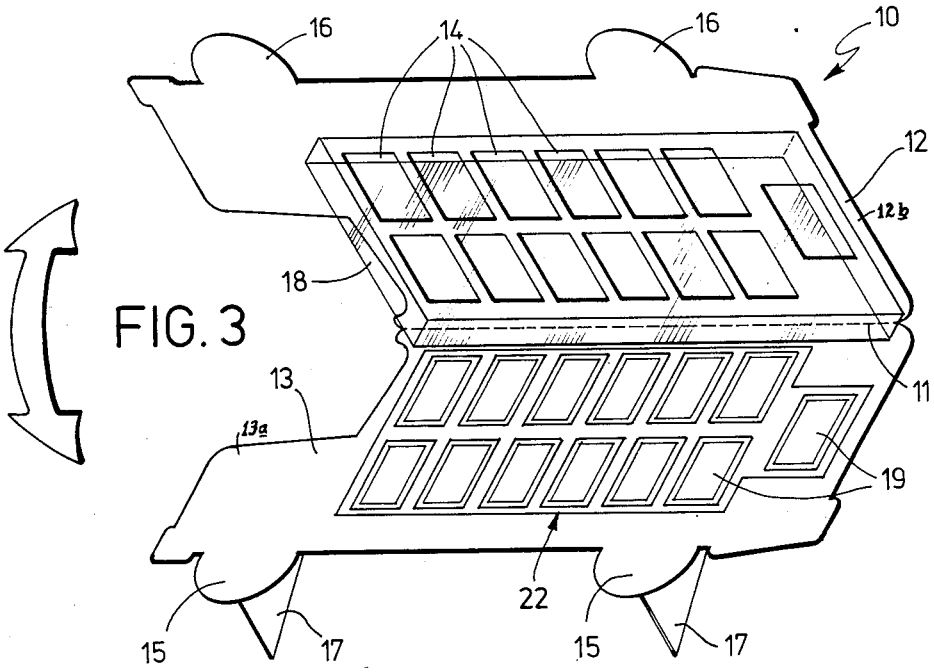

More specifically, with just the two panels 12 and 13, the specified connection of the panels here shown as a fold-connection 11 provides a connection means both economical and easy to use, readily and conveniently permitting them to be moved into and between an assembled or display condition of FIG. 1, in which they are juxtaposed, and an open or access condition of FIGS. 2 and 3, in which they are separate for manual access to photos mounted between them, that is, access to the inner face 13*a* of the inner panel 13 for photo-mounting described herein.

The outer panel 12 is shown as provided with a series of cut-outs or openings 14, shown here as rectangular, resembling windows of the school bus device 10, through which pictures (not shown) as would be carried on the inner face 13*a* of the inner panel 13 would show through.

Enhancement of the overall school bus design or charactery is also by providing both the inner panel 13 and outer panel 12, respectively, with integral extensions 15 and 16 of semi-circular shape to resemble wheels and tires.

The wheel/tire extensions 15 of the inner panel 13 also provide a location for the mounting of braces 17 for supporting the device 10 if it is to be displayed on a shelfmount rather than as a wall-hung display. The braces are provided with a fold-crease, conventional with photo-mounts, for use as a prop for the device 10 when in stand-up display as on a shelf or table. For wall mounting, the braces 17 are folded and hidden from view behind the wheel/tire extensions 15.

Also, as best shown in FIG. 3 and as partially shown in FIG. 2, there is provided a transparent sheet body 18 which is carried between the outer panel 12 and the inner panel 13; and the transparent sheet body 18 provides, as the device 10 is viewed from outwardly of the outer panel 12, what appears to be window glass for all the openings 14, further enhancing the overall charactery as appearing that of a school bus with plurality of glass windows. The sheet 18 is shown in FIG. 3 as affixed to the inner face 12*b* of the outer panel 12, the sheet 18 being of a large size so that it underlies the totality of the panel cut-out openings 14, achieving the window glass effect mentioned.

A further desirable feature of the device 10 is that the inner face 13*a* of the inner panel 13 is provided with locators 19, marked and/or embossed onto the innerpanel 13, which locators 19 respectively are in registry with the openings 14 of the outer panel 12 when the panels 12/13 are in their assembled or display condition as shown in FIG. 1.

As described above, it will be seen that the arrangement provides that when a series of the child's photographs are mounted onto the inner face 13*a* of the inner panel 13, in locations as indicated by the locators 19, and the panels 12/13 are moved to their assembled or display condition of FIG. 1, whatever are the pictures which are then so mounted will appear as respectively visible through what appear to be glass of the windows 14 of the school bus. With the device 10, the relative movability of the panels 12/13 provides that they may be readily moved to their open or access condition (FIGS. 2 or 3) from time to time, to provide the sequential mounting and thus additional inclusion of individual ones of a series of photographs of a child as the child matures.

Further novelty and attractiveness of the school bus device 10 is provided by the portion 20 (FIG. 1) of the outer panel 12 depicting the rear of the school bus being shown in a perspective manner, for even though the entire panel 12 is economically only of two-dimensional nature, it enhances a three-dimensional appearance of the school bus body.

Additional interest of the device 10 as a historical pictorial record of a certain specific child is the provision of a nameplate body 21 (FIG. 1) on the outer panel 12.

As further illustrated particularly in FIG. 1, the outer panel 12 is shown provided to have design features of a school bus, co-operating with the array of photos indicated schematically with reference designator 22 (FIG. 3), as turn lights 24, extra roof lights 25, brake lights 26 and tail lights 27 (FIG. 1).

As an alternative to the shelf-mounting helped by the props 17, a wall-hung display may be desired; and a hole 28 (FIG. 2) is accordingly provided in the inner or rear panel 13, desirably close to the hinge line 11.

The photographic record is labelled by labels for the windows 14, such as "KG" (for the kindergarten photo), then numerical designators from "1st" through "12th" for the photos of the numbered school grades.

CONCLUSION

It is thus seen that a school bus device, constructed and used according to the inventive concepts herein set forth, provides novel concepts of a desirable and advantageous photo-display device, yielding the advantages of an easily used display of a sequence of photos as a child grows up; and the assembly and/or change of photos are both quite convenient.

Accordingly, it will thus be seen from the foregoing description of the invention according to this illustrative embodiment, considered with the accompanying drawings, that the present invention provides new and useful concepts of a novel and advantageous photo mount and photo-display device having and yielding desired advantages and characteristics in construction and use, and accomplishing the intended objects, including those hereinbefore pointed out and others which are inherent in the invention.

Inventiveness is shown by novel features of concept and construction shown herein, and by the novel concepts hereof not only being different from all the prior art known, but because the achievement is not what is or has been suggested to those of ordinary skill in the art, especially realistically considering this as such a non-technical device known to all persons, and whose contrasting counterparts in conventional picture mounts are known and have been known for scores of years the entire world over. No prior art has suggested the modification of any prior art to achieve the novel concepts here achieved, and quite certainly no particular combination of references has been suggested by the prior art, this achievement being a substantial departure from prior art, even though quite a variety of prior picture-mounts are surely known to all persons, even mountings of different age photos of the same person.

Modifications and variations may be effected without departing from the scope of the novel concepts of the invention; accordingly, the invention is not limited to the specific embodiment, or form or arrangement of parts herein described or shown.

We claim:

1. A display mount device, comprising:

a pair of body members connected by connection means and providing an outer panel and an inner panel, at least one of the panels being shaped and presented so as to provide a charactery of a school bus, the connection of the panels providing a connection means permitting them to be moved into and between an assembled or display condition in which they are juxtaposed, and an open or access condition in which they are separate for manual access to the inner face of the inner panel, the outer panel being provided with a series of openings resembling windows of the school bus, through which pictures carried on the inner face of the inner panel show through, a transparent sheet body means carried between the outer panel and the inner panel, providing, as viewed from outwardly of the outer panel, what appears to be window glass for all the openings, the inner face of the inner panel being provided with locators which respectively are in registry with the openings of the outer panel when the panels are in their assembled or display condition, the arrangement providing that when a series of photographs are mounted onto the inner face of the inner panel, in locations as indicated by the locators, and the panels are moved to their assembled or display condition, whatever are the pictures then so mounted will appear as respectively visible through what appear to be glass windows of the school bus, the relative movability of the panels providing that they may be readily moved to open or access condition from time to time, to mount, sequentially, individual ones of a series of photographs of a child as the child matures.

2. A device according to claim 1, in which the portion of the outer panel depicting the rear of the school bus is shown in a perspective manner, enhancing a three-dimensional appearance of the school bus body.

3. A device according to claim 1, in which there is provided a nameplate body on the outer panel.

4. A device according to claim 1, in which the outer panel is provided to have design features of a school bus.

* * * * *

UNITED STATES PATENT AND TRADEMARK OFFICE

CERTIFICATE OF CORRECTION

PATENT NO. : 4,794,716

DATED : January 3, 1989

INVENTOR(S) : Max A. George; Janet L. George

It is certified that error appears in the above-identified patent and that said Letters Patent is hereby corrected as shown below:

| | |
|---|---|
| Col. 2, line 35 | "outer" should be "inner". |
| Col. 2, line 35 | After "face" should be inserted: "(that is, the face which faces toward the viewer and inwardly toward the panel which is outer in the sense of being most adjacent the viewer)". |
| Col. 2, line 40 | "outer" should be "inner". |
| Col. 3, line 28 | "inner" should be "outer". |
| Col. 3, line 29 | "outer" should be "inner". |
| Col. 6, line 3 | "We claim" should be "CLAIMS". |

Signed and Sealed this

Seventeenth Day of October, 1989

*Attest:*

*Attesting Officer*

DONALD J. QUIGG

*Commissioner of Patents and Trademarks*